US005576703A

United States Patent [19]

MacLeod et al.

[11] Patent Number: 5,576,703

[45] Date of Patent: Nov. 19, 1996

[54] METHOD AND APPARATUS FOR COMMUNICATING SIGNALS FROM WITHIN AN ENCASED BOREHOLE

[75] Inventors: Norman C. MacLeod, deceased, late of Sunnyvale, by Martha H. MacLeod, legal representative; Roger N. Samdahl, San Jose, both of Calif.; Thomas R. Bandy, Katy, Tex.

[73] Assignee: Gas Research Institute, Chicago, Ill.

[21] Appl. No.: 574,950

[22] Filed: Dec. 19, 1995

Related U.S. Application Data

[62] Division of Ser. No. 71,797, Jun. 4, 1993.

[51] Int. Cl.[6] ..... G01V 1/00

[52] U.S. Cl. ..... 340/854.4; 340/854.6; 340/854.8; 340/854.5; 175/40

[58] Field of Search ..... 340/854.4, 854.6, 340/854.8, 854.5; 175/40

[56] References Cited

U.S. PATENT DOCUMENTS 5,394,141 2/1995 Soulier ..... 340/854.4

*Primary Examiner*—J. Woodrow Eldred
*Attorney, Agent, or Firm*—Dick and Harris

[57] ABSTRACT

A method and apparatus for communicating signals from within an encased borehole including a wireless communications system for transmitting down-hole environmental data signals between a down-hole tool and a surface receiver. The down-hole tool is disposed within a borehole encased in an electrically conductive casing; the receiver is located at the ground surface. The tool includes a conductive upper and lower tool housing, a plurality of down-hole sensors, and a signal generating device. The sensors and signal generating device are housed within the tool. The generating device receives analog or digital signals of the down-hole environmental conditions from the sensors, converts these signals into a modulation pattern signal which is applied to a carrier signal and conducts a modulated carrier signal into the upper and lower tool housings. An upper contactor or spreader electrically connects the upper housing to a first position on an inside wall of the casing. Similarly, a lower contactor or spreader electrically connects the lower housing to a second position on the inside wall of the casing. The first and second positions are spaced-apart by a predetermined separation, and define a casing conducting portion therebetween. The transmitted drive signal cause a reciprocating current to flow through the conducting portion thereby inducing a voltage potential on the outside of the well-casing which forms corresponding dipolar electromagnetic field in the earth surrounding the conductive portion and propagating the field upward to be received by the surface receiver.

5 Claims, 7 Drawing Sheets

METHOD AND APPARATUS FOR COMMUNICATING SIGNALS FROM WITHIN AN ENCASED BOREHOLE

This is a division of application Ser. No. 08/071,797, filed Jun. 4, 1993 pending.

BACKGROUND OF THE INVENTION

1. Field of the Invention

This invention relates to the communication of signals from within a cased borehole or other metallic conduit and, more particularly, to a wireless communication system which utilizes current generated within a short segment of an electrically conductive conduit to develop electromagnetic energy for communicating a signal, generated by a transmitter located within the conduit, to a remote receiver.

2. Description of the Prior Art

One of the present methods to improve oil and gas flow in oil wells is to inject acid or mixtures of water and sand at high pressures into the producing formation strata in the oil well. This process is commonly referred to as a well stimulation process.

In order to design and operate a successful well stimulation process, it is important to determine a number of down-hole conditions. Of these conditions, the most important are the actual bottom-hole pressure and temperature measured at the face of the producing formation while the stimulation process is being performed; i.e., the "real-time" bottom-hole pressures and temperatures. If those "real-time" parameters were available for evaluation during the stimulation operation, then the stimulation process is improved, and overall stimulation costs are reduced.

Among the existing methods of obtaining data relating to the down-hole pressures and temperatures during well stimulation procedures are the following:

1. Data can be obtained using a measuring instrument recorder which is disposed at the bottom of the hole and is then retrieved after the stimulation process is completed. Unfortunately in using this technique, the down-hole conditions can only be replayed at the end of the stimulation process and this data is not "real-time" data.

2. Bottom-hole conditions can be calculated based on conditions measured at the surface that estimate the wellbore conditions. However, the accuracy of these indirect measurements is generally poor because the measured and estimated conditions are constantly changing throughout the stimulation process.

3. Sensing devices can be placed down-hole with an electrical cable or wireline communicating between the sensing device and the surface. This method can provide a reliable communications link but is costly, and the cable or wireline is prone to tangling, breaking or interfering with the fluid flow in the borehole.

In addition, a number of other prior art wireless wellbore communication systems are known. Many of these systems are designed specifically to be used in the drilling industry as "measurement-while-drilling" systems. Typically these systems use apparatus mounted directly above the drill bit to record the drilling conditions in the vicinity of the drilling bit. The drilling data is modulated into an electric signal and transmitted by propagating electromagnetic energy through the strata adjacent to the drill pipe and decoding those signals at the surface. From these signals the conditions of the drilling environment and adjacent strata can be determined. Examples of such technology can be seen in U.S. Pat. Nos. 4,578,675 and 4,739,325 issued to MacLeod. The MacLeod devices include instrumentation that produces and receives signals at the bottom of the well hole. However, the MacLeod device is not readily adaptable for use in pre-drilled holes cased with an electrically conductive conduit. Also, the MacLeod device cannot be used with the well stimulation procedures because such procedures are employed after the casing is installed in the well hole.

U.S. Pat. No. 3,831,138 issued to Rammner discloses a method of communicating drilling conditions from a position near the drill bit to the surface using electric signals. This device operates by creating a dipole in the body of the drill tube just above the drill bit. The dipole transfers electric current to the strata in the vicinity of the drill bit, and this current is propagated through the strata to the surface in the form of a current field. The Rammner device cannot be utilized where there is a conductive casing in the borehole, such as a well casing, Yet another method of communicating with the surface is shown in U.S. Pat. No. 4,839,644 issued to Safinya et al., which discloses a system for wireless, two-way electromagnetic communication along a cased borehole which has a metallic tubing string extended down into it. One part of the communications system is located at or near the base of the tubing, and another part is located at the surface. Communication is achieved by transmitting electromagnetic energy to the surface through the casing/tubing annulus. A disadvantage of this system is that effective operation requires the tubing to be insulated from the casing, in order to eliminate electrical shorts caused by the tubing-casing contact. Thus, non-conductive spacers and a non-conductive fluid must be provided in the annulus space between the tubing and the casing, thereby increasing the cost, making the Safinya device logistically difficult to employ, and commercially inapplicable in most well stimulation operations.

Yet another wireless communication system is disclosed in U.S. Pat. No. 3,967,201 issued to Rorden. This patent discloses a method of communication whereby low frequency electromagnetic energy is transmitted through the earth between two generally vertically orientated magnetic dipole antennae. One antennae, located at a relatively shallow depth within the borehole, includes an elongated electrical solenoid with a ferro-magnetic core and generates relatively low frequency electromagnetic energy which propagates through the earth. The device can be used in a cased borehole; however, as admitted in the specification (col. 3, lines 17–19), communication is much more difficult if the casing is present in the borehole. Also, the specification describes art for communicating at shallow depths (0–2000') and for controlling the operation of a shallow down-hole valve and does not disclose how this technology can be used for communication of information from much deeper holes and through the relatively hostile environment created by well stimulation techniques.

Notwithstanding all the above described prior art, the need still exists for a relatively inexpensive, routinely usable, efficient method of wireless communication from the bottom of an encased borehole to the ground surface.

SUMMARY OF THE INVENTION

Objects of this Invention

Accordingly it is an object of this invention to provide a wireless communication system which can be used in a cased borehole at depths ranging from 0 to 15,000' or more.

It is a further object of this invention to provide such a communication system which can operate under the adverse conditions of a well stimulation procedure.

It is yet another object of this invention to provide an apparatus which can be located down-hole in a cased borehole, and transmits energy, corresponding to down-hole sensor data, that is through the casing and through the earth's strata, adjacent to the borehole, to a remote electrode located at the surface.

SUMMARY OF THE INVENTION

Briefly, the present invention including a wireless communications system for transmitting down-hole environmental data signals between a down-hole tool and a surface receiver. The down-hole tool is disposed within a borehole encased in an electrically conductive casing; the receiver is located at the ground surface. The tool includes a conductive upper and lower tool housing, a plurality of down-hole sensors, and a signal generating device. The sensors and signal generating device are housed within the tool. The generating device receives analog or digital down-hole environmental data signals from the sensors, converts these signals into a modulation pattern signal which is applied to a carrier signal and transmits a modulated carrier signal into the upper and lower tool housings. An upper contactor or spreader electrically connects the upper housing to a first position on an inside wall of the casing. Similarly, a lower contactor or spreader electrically connects the lower housing to a second position on the inside wall of the casing. The first and second positions are spaced-apart by a pre-determined separation, and define a casing conducting portion therebetween. The transmitted drive signals cause a reciprocating current to flow through the conducting portion thereby inducing a corresponding electromagnetic field in the earth surrounding the conductive portion and propagating the field upward to be received by the surface receiver.

ADVANTAGES OF THE INVENTION

A primary advantage of this invention is that it provides a wireless communication system which can be used in a cased borehole.

Yet another advantage of this invention is that it provides a method of "real-time" communication of signals from within a cased borehole to a surface receiver.

Still another advantage of this invention is that it can be used to provide "real-time" down-hole data during a well stimulation operation.

These and other objects and advantages of the present invention will no doubt become apparent to those skilled in the art after having read the following detailed description of the preferred embodiment which is illustrated in the several figures of the drawing.

DESCRIPTION OF THE EMBODIMENTS

Description of Environment

Figure 1:
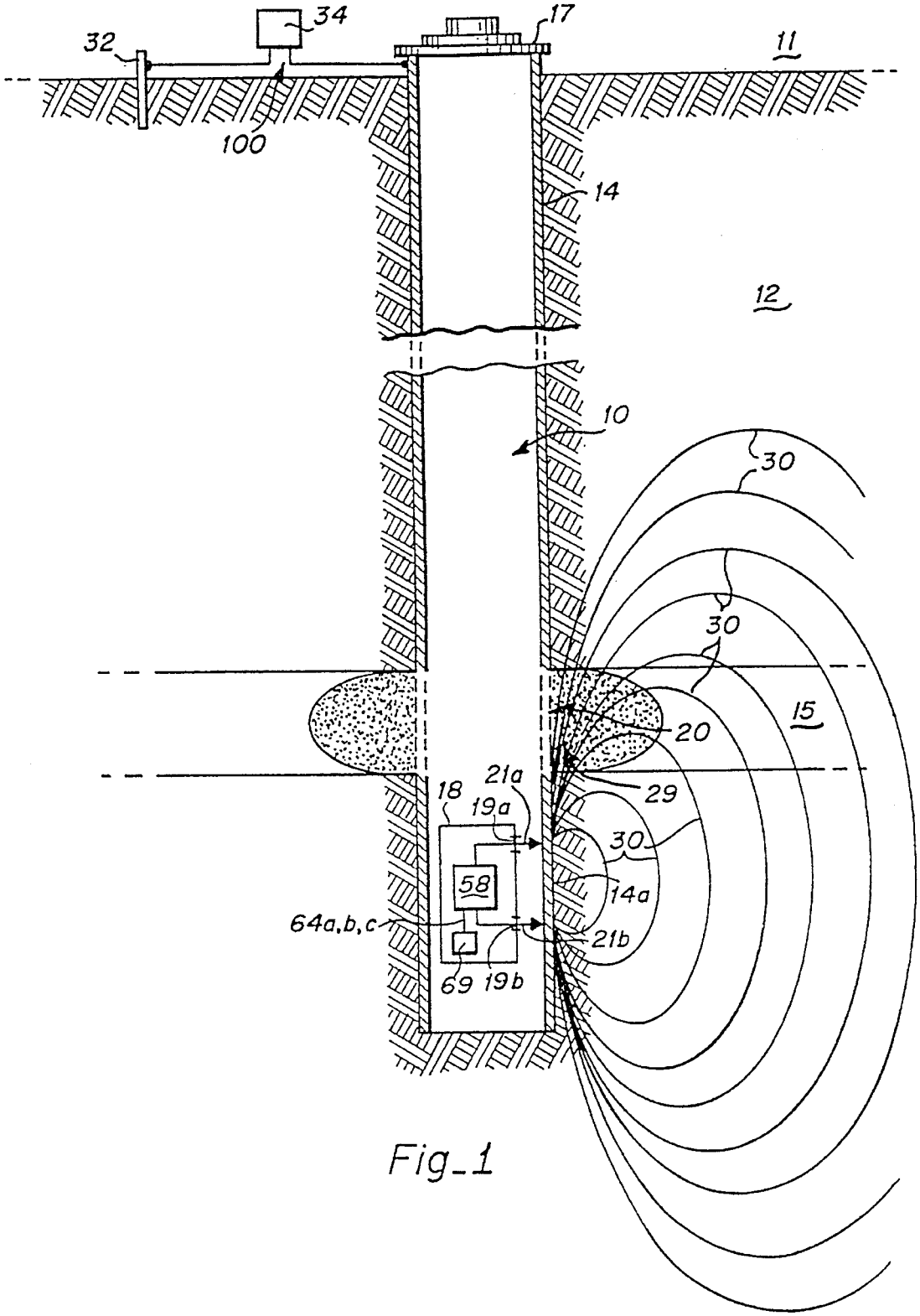
FIG. 1 illustrates a partial cross-section view of a cased borehole, having disposed within a single-housing down-hole tool 18 of the present invention.

FIG. 1 shows a borehole 10 formed through a portion of the earth 12. Typically, this borehole 10 may range in depth from 1,000 feet to 20,000 feet or more beneath the surface 11, the borehole includes a metal lining or electrically conductive casing 14 which extends over all, or a substantial portion, of the borehole 10 depth. The borehole 10 is capped, at the surface, by a wellhead 17.

During a well stimulation process, a mixture of sand and water (slurry) is forced, under pressure, down the borehole 10 to a producing formation strata 15 where it is forced through a plurality of casing perforations 20 adjacent to the producing formation strata 15. This process, called fracturing, forces the producing formation 15 to crack apart allowing the sand/water slurry to fill a single fracture or a plurality of fractures 29 formed in the strata 15. Once the stimulation process has been completed, the water mixture is "flowed back" or removed from the borehole 10 allowing the fracture 29 to "heal" or settle back on top of the sand pumped into the fracture 29. This leaves fracture 29 of extremely high or infinite permeability surrounding the casing perforations 20 thereby facilitating oil or gas flow into the borehole 10 and ultimately up to the surface.

It is important to monitor the pressure and temperature at or near the casing perforations 20 during the well stimulation process. This can be accomplished, according to the present invention, by placing a down-hole tool 18 at a location in the borehole 10 just below the casing perforations 20. As illustrated in FIG. 1, the down-hole tool 18 is located just below the casing perforations 20 so as not to interfere with the flow of any fluid component of the fracturing operation. The tool 18 is lowered into the borehole by means of a wireline or slickline unit (not shown).

General Operation

The tool 18 is a one-piece or single housing device that houses a signal generating device 58 that may include a sensing device 69 for measuring environmental conditions existing within the borehole. Alternately, as illustrated, the sensing means 69 may be separate from the generating device 58. The device 58 produces a driving current associated with the measured environmental conditions. The current is output over an upper and lower conductor 21*a*, 21*b* which contact an inner surface of the casing 14 in a spaced-apart arrangement so as to define a casing conduction portion 14*a* therebetween. The portion 14*a*, in the present embodiment, ranges from eight to twenty feet in length. The length of the portion 14*a* is not believed to be related to the frequency of transmission, and to date has been limited only by physical limitations imposed by the borehole and operations therein.

The alternating or reciprocating current that flows in the casing conducting portion 14*a* creates an electromagnetic field represented by a plurality of field lines 30. The field emanates from the outer surface of the casing, propagates through the earth 12, and is received at the surface 11 by a surface receiver or antenna 34. The receiver 34 utilizes an electric field 30*a* portion of the electromagnetic energy that is sensed between a remote electrode 32 and the casing 14. Although the current embodiment utilizes electrical measurement, a magnetic measurement system could also be implemented.

The surface receiver 34 amplifies, signal conditions, and decodes the electrical measurement. It then displays the data received from the down-hole tool 18 to a user.

The conductors 21*a*, 21*b* pass through the housing of the tool 18 at an upper and lower insulator/seal 19*a*, 19*b*. The tool is usually assembled and sealed on the surface (i.e. the internals of the tool are at atmospheric pressure). When the tool is disposed in the down-hole location, the tool could be exposed to high environmental pressures that exist in the vicinity of the tool. The seals, therefore, could be exposed to high differential pressures and may fail, thereby breaching the integrity of the housing. Consequently, the seals must be sufficiently robust in design or construction to withstand high pressure gradients. In order to obviate this potential problem, the preferred embodiment of the present invention utilizes a split housing design.

Figure 1A:
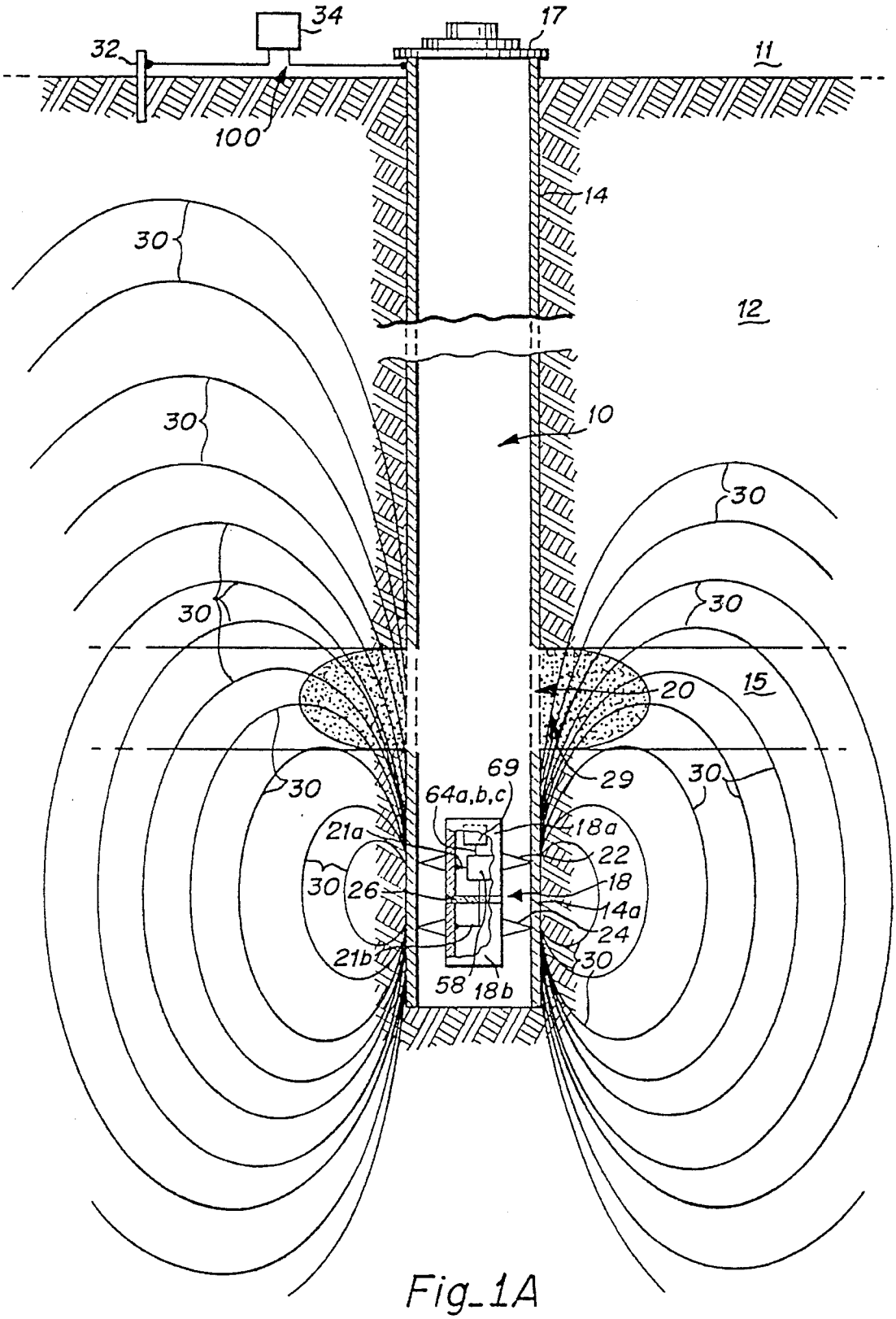
FIG. 1A illustrates a partial cross-section view of a cased borehole, having disposed within the preferred embodiment of the tool 18 illustrated in FIG. 1.

FIG. 1A illustrates the preferred embodiment of the present invention which includes the down-hole tool 18 having an upper tool housing 18a and a lower tool housing 18*b* electrically separated from each other by means of an electrically insulated gap or spacer 26. An upper contactor or spreader 22 is attached to the upper tool housing 18*a* and is arranged to make electrical contact with the inner surface of the casing 14. Similarly, a lower contactor or spreader 24 is connected to the lower tool housing 18*b* and is arranged to make contact with the inner surface casing 14.

Environmental conditions (e.g. pressure, temperature) existing within the borehole are measured by the sensing device 69. The device 58 converts analog or digital signals 64*a*, 64*b*, 64*c*, corresponding to the measured environmental conditions, into a modulation pattern signal applied to a carrier signal. The device 58 produces a potential difference across the electrically insulated gap or spacer 26 by electrically communicating via the conductors 21*a* and 21*b*, low frequency electromagnetic energy corresponding to the environmental data signal directly to the inner surface of the upper and lower tool housings 18*a*, 18*b*. This energy is communicated, via the upper and lower spreaders 22 and 24, to the casing conducting portion 14*a* which represents the device 58 load.

It should be noted that in the preferred embodiment, the electrical energy communicated from the transmitter to the upper and lower housings is conducted completely within the tool housing itself. The energy is then communicated, via the spreaders, to the inner surface of the casing. Thus, the energy conducted from the transmitters to the casing need not be conducted through pressure seals disposed in the housing; since no seals are required and the problem of seal failure is avoided. It should be further noted that the device 58 may be installed either above or below the gap.

As described earlier, an alternating or reciprocating current is produced and flows in the casing conducting portion 14*a* and creates an electromagnetic field represented by a plurality of field lines 30. As illustrated, the field lines 30 emanate from the outer surface of the casing, and not from the tool inside it. A corresponding electromagnetic wave propagates throughout the earth 12 and is received at the surface 11 by the surface receiver or antenna 34.

Other Down-Hole Configurations

Figure 2:
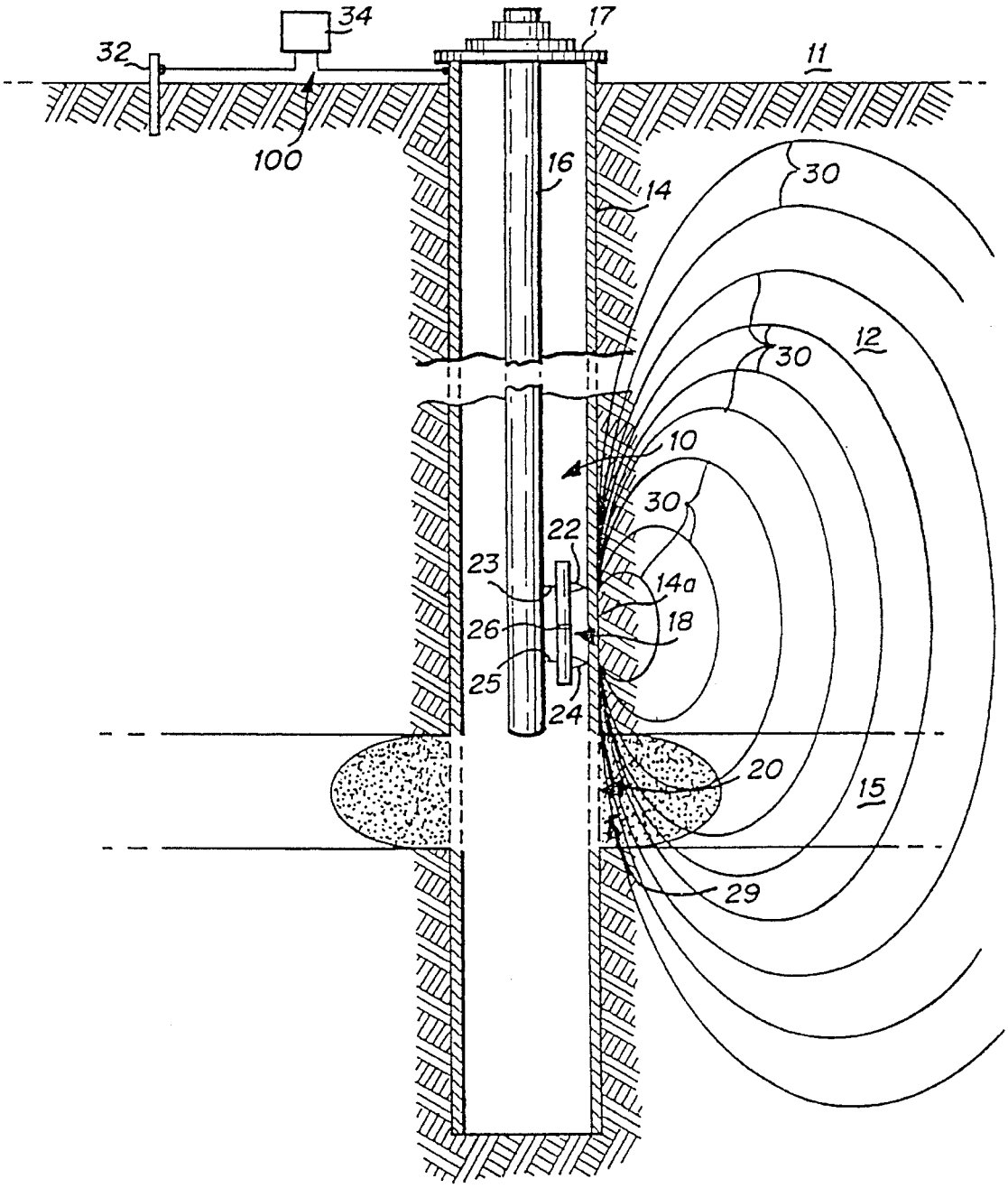
FIGS. 2, 3, 3A, and 4 illustrate a partial cross-section view of a cased borehole, having disposed within alternate embodiments of the down-hole tool 18 illustrated in FIG. 1, 1A.

As illustrated in FIG. 2, many wells dispose a metal tubing 16 within the borehole 10 and extend the tubing 16 from the wellhead 17, at the surface 11, to a level terminating somewhere above the producing formation strata 15. In such wells, the stimulation process is achieved by pumping the slurry through the metal tubing 16, out of the casing perforations 20, and into the producing formation strata 15 in the earth 12. The water mixture is removed, after the fracturing operation, through the metal tubing 16.

In this embodiment, the down-hole tool 18 (identical to the tool illustrated in FIG. 1A) is located at or near the lower end of the metal tubing 16 and is affixed to the metal tubing by means of an upper electrically insulating attachment 23 and a lower electrically insulating attachment 25. The upper and lower insulating attachments 23 and 25 ensure that most of the energy from device 58 (FIG. 1A) is communicated to the casing conducting portion 14*a* (i.e between the spreaders 22 and 24); very little transmitter energy is conducted to the metal tubing 16.

The tool 18 includes the upper tool housing 18*a* and the lower tool housing 18*b* which are electrically separated from each other by means of the electrically insulated gap or spacer 26. The upper spreader 22 is attached to the upper tool housing 18*a* and is arranged to make electrical contact with the casing conducting portion 14 of the borehole 10. Similarly, the lower spreader 24 is connected to the lower tool housing 18*b* and is arranged to make contact with the casing conducting portion 14 of the borehole 10. This embodiment is a permanent tool that stays in the well until the tubing 16 is removed from the borehole 10. The operation of the down-hole tool 18 is as described above.

Figure 3:
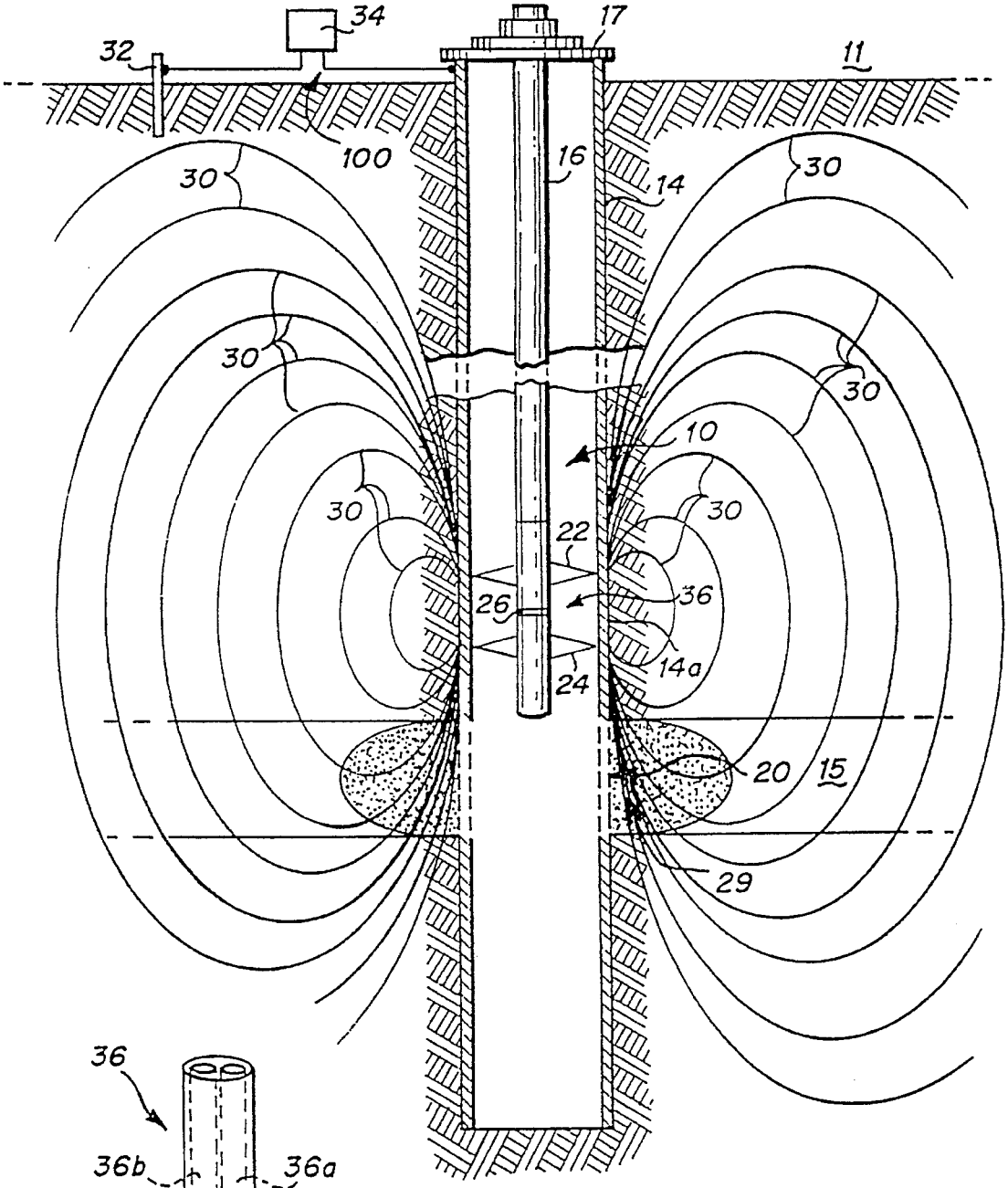

In FIG. 3, a different embodiment of down-hole tool 18 is illustrated. This embodiment is also used when the metal tubing 16 is disposed in the borehole 10. In this case, a tubing carrier 36 1s disposed at the bottom section of the metal tubing 16. The upper spreader 22 is attached to the upper portion of the tubing carrier 36 and makes electrical contact with the casing conducting portion 14*a* of the borehole 10. Similarly, the lower spreader 24 is connected to the lower portion of the tubing carrier 36 and makes contact with the casing conducting portion 14*a* of the borehole 10.

Figure 3A:
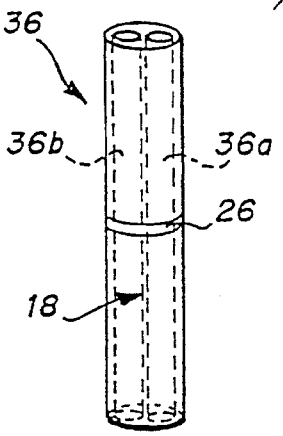

FIG. 3A illustrates the tubing carrier 36 in greater detail; it should be noted that the spreader 22 and 24 have been omitted for clarity. The carrier 36 includes two adjacent bores: a tool carrier section 36*b*, and a flow section 36*a* through which the sand/water slurry can be pumped. The down-hole tool 18 is inserted into the tool carrier section 36*b* and is affixed to the tool carrier section 36*b* at both the upper and lower tool housing 18*a*, 18*b* (not shown). The carrier section 36*b* is adequately insulated in such a manner to ensure most of the energy from the device 58 (not shown) is communicated to a section of the carrier 36 contacting the spreaders 22 and 24, and that very little energy is transmitted to section 36*a* or the tube 16.

The tubing carrier 36 is inserted into the metal tubing 16 at a point which will be result in its being just above the perforations 20 after the tubing is run into the borehole 10.

This embodiment is a permanent tool that stays in the well until the tubing 16 is removed from the borehole 10. The operation of the down-hole tool 18 is as described above.

Figure 4:
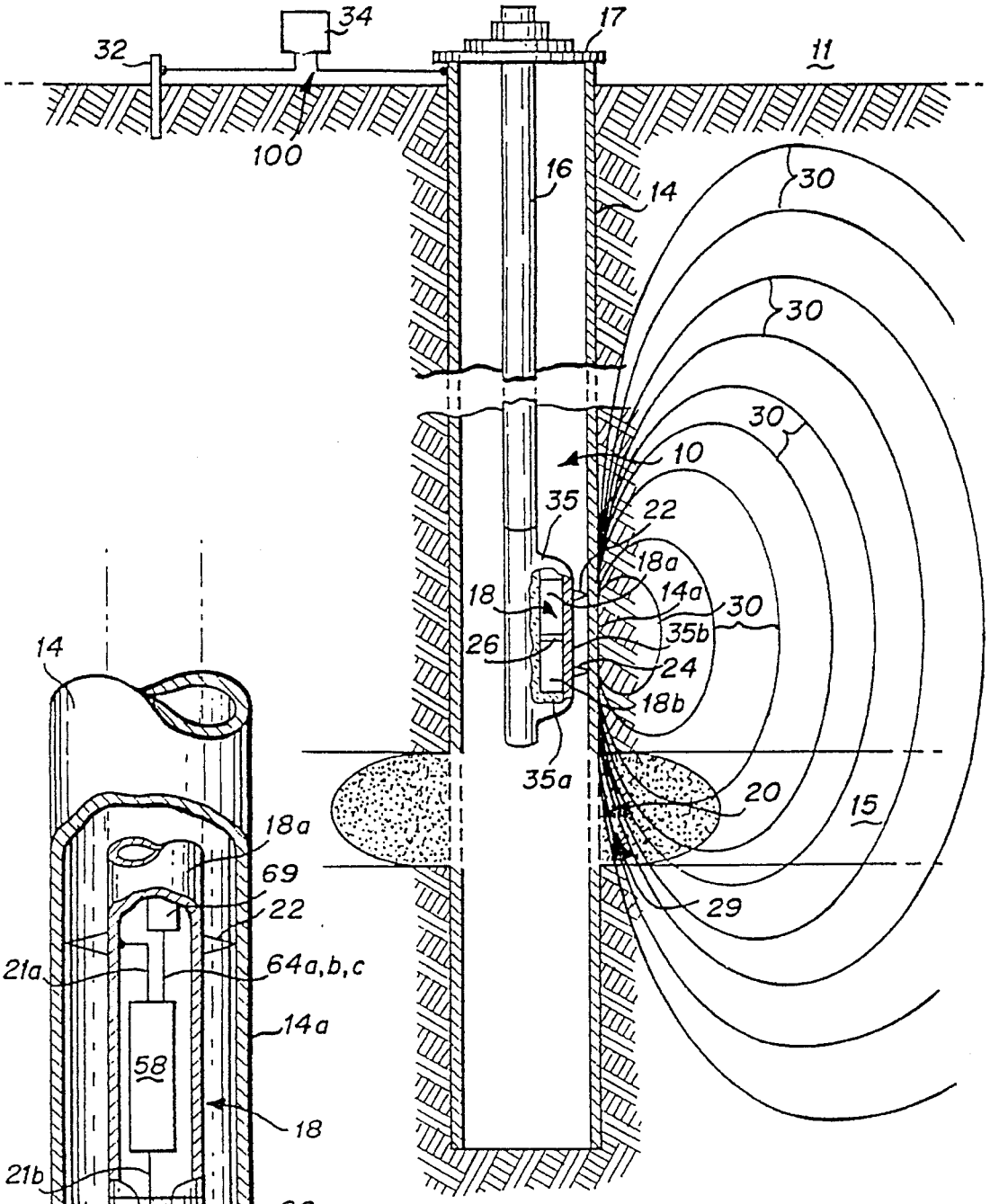

FIG. 4 illustrates yet another embodiment of the down-hole tool 18 which can be used as either a retrievable tool or as a permanent tool. This embodiment is also used when the metal tubing 16 is disposed in the borehole 10. A side pocket mandrel 35 is attached to the bottom section of the metal tubing 16. The upper spreader 22, attached to an upper portion of an outer shell 35*b* is arranged to make electrical contact with the casing conducting portion 14*a* of the borehole 10. Similarly, the lower spreader 24, connected to the lower portion of the outer shell 35*b*, is arranged to make contact with the casing conducting portion 14*a* of the borehole 10. The side pocket mandrel 35 is located just above the perforations 20 after the tubing is run into the borehole 10.

The mandrel 35 is insulated so that energy from the device 58 (not shown) is conducted out through the housings 18*a*, 18*b* and into the outer shell 35*b*; an inner insulation 35*a* minimizes the energy transmitted from the device 58 into the mandrel 35 and tubing 16.

The down-hole tool 18 can be inserted into the sidepocket mandrel 35 either while the mandrel is at the surface prior to placing the tubing 16 into the well, or the down-hole tool 18 can be placed into the side pocket mandrel 35 after the metal tubing 16 is in its final position in the borehole 10 by use of a wireline or slickline unit (not shown). Its operation is then identical to that of the down-hole tool 18 described in FIG. 3. After use, the down-hole tool 18 can be retrieved by the same wireline or slickline unit. Alternatively, the down-hole tool 18 can also be retrieved when the metal tubing 16 is removed from the borehole 10.

Detailed Description of Circuitry

Figure 5A:
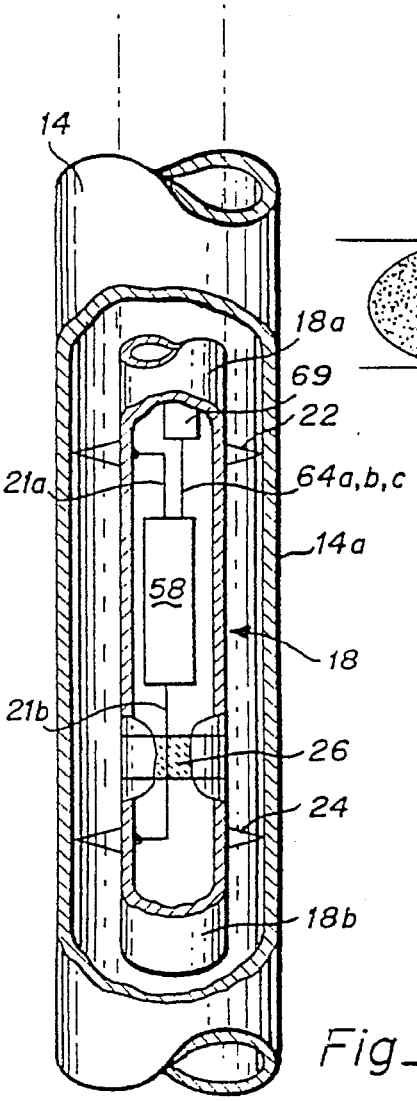
FIG. 5A is an enlarged schematic illustration of the installation of the communication system 58 within the down-hole tool 18.

FIG. 5A, enlarges the view of the tool 18 shown in FIG. 1A, and illustrates the location of the device 58 and the sensing means 69 in the tool 18. As noted earlier, the device 58 could be located on either side of the gap 26 and the sensing means 69 could be located within or outside of the device 58. The electrical interface between the system 58 and the upper and lower housing 18*a*, 18*b* is also shown.

Figure 5B:
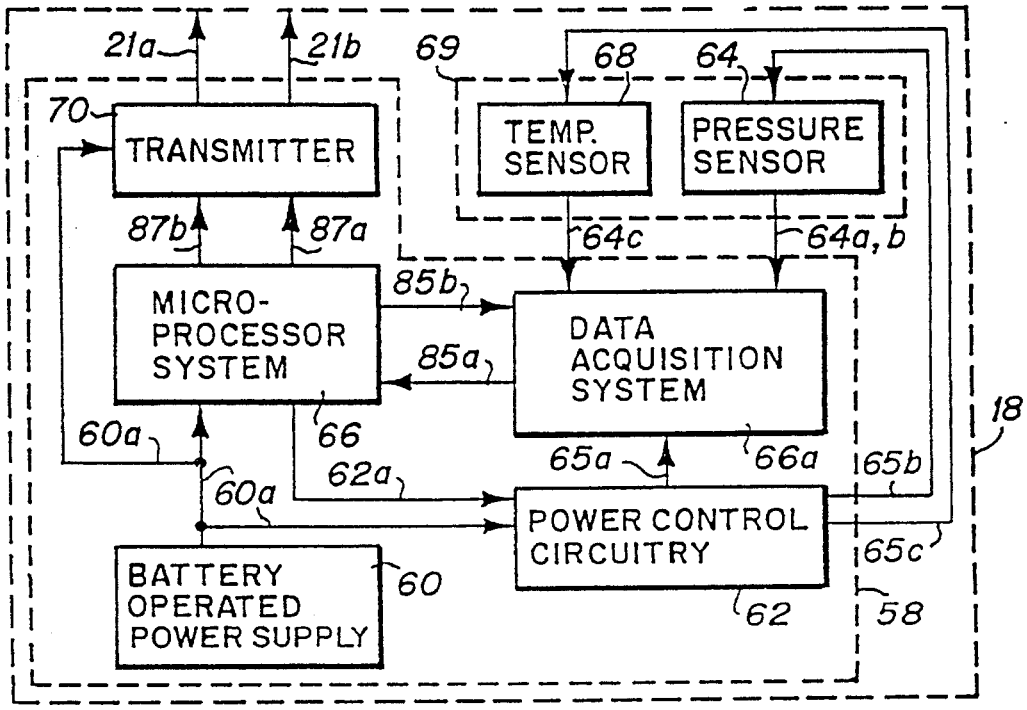
FIG. 5B is a block diagram of the communication system 58.

FIG. 5*b* depicts a block diagram of the system 58. The communication system 58 includes a battery operated power supply 60 which supplies a first power voltage to a microprocessor system 66, a power control circuitry 62 and a transmitter 70. The microprocessor system 66, which controls the data acquisition, processing and transmission, is connected to the power control circuitry 62, a data acquisition system 66*a*, and the transmitter 70.

The sensing means 69, which may be located within or outside the device 58, includes a pressure sensor 64 and a temperature sensor 68 which are connected to the data acquisition system 66*a* and the power control circuitry 62. In this manner, a suitably programmed microprocessor system 66 can activate or deactivate, via a second power voltage 65*b*, 65*c*, any or all of the modules (e.g. temperature, pressure sensors) connected to the power control circuitry 62 if a predetermined time interval elapses or if the pressure in the vicinity of the down-hole tool 18 exceeds a certain predetermined threshold value. Thus, the down-hole system can be made to operate only during the well stimulation process; this serves to extend the life span of the battery operated power supply 60. It is noted that the sensing means 69 could include a different number or variety of sensors measuring environmental parameters other than or in addition to temperature and pressure.

Signals 64*a*, 64*b*, 64*c* from the pressure sensor 64 and temperature sensor 68 are received and digitized by the acquisition system 66a, and are output to the microprocessor system 66. After correcting for acquisition system 66*a* scale factors and offset errors on both measurements and correcting for temperature effects on the pressure sensor 64 measurement, a digitized sensor signal 85*a* is modulated by the microprocessor system 66 and output to the transmitter 70 as modulation pattern signals 87*a*, 87*b*.

The transmitter 70, in response to the signals 87*a*, 87*b*, couples the power voltage 60*a* to the upper and lower sections 18*a* and 18*b*, via the conductors 21*a* and 21*b*. The housings 18*a* and 18*b* are insulated from one another by means of the electrically insulated gap or spacer 26 and are electrically connected to the casing conducting portion 14*a* via the upper spreader 22 and the lower spreader 24, respectively. The upper tool housing 18*a*, the lower tool housing 18*b*, the electrically insulated gap or spacer 26, the upper spreader 22, and the lower spreader 24 combine to cause transmitting current to flow through the well casing. This current causes a voltage potential to develop on the outside of the well casing which forms a dipolar field for transmitting the measured information to the surface receiver 34.

Figure 6:
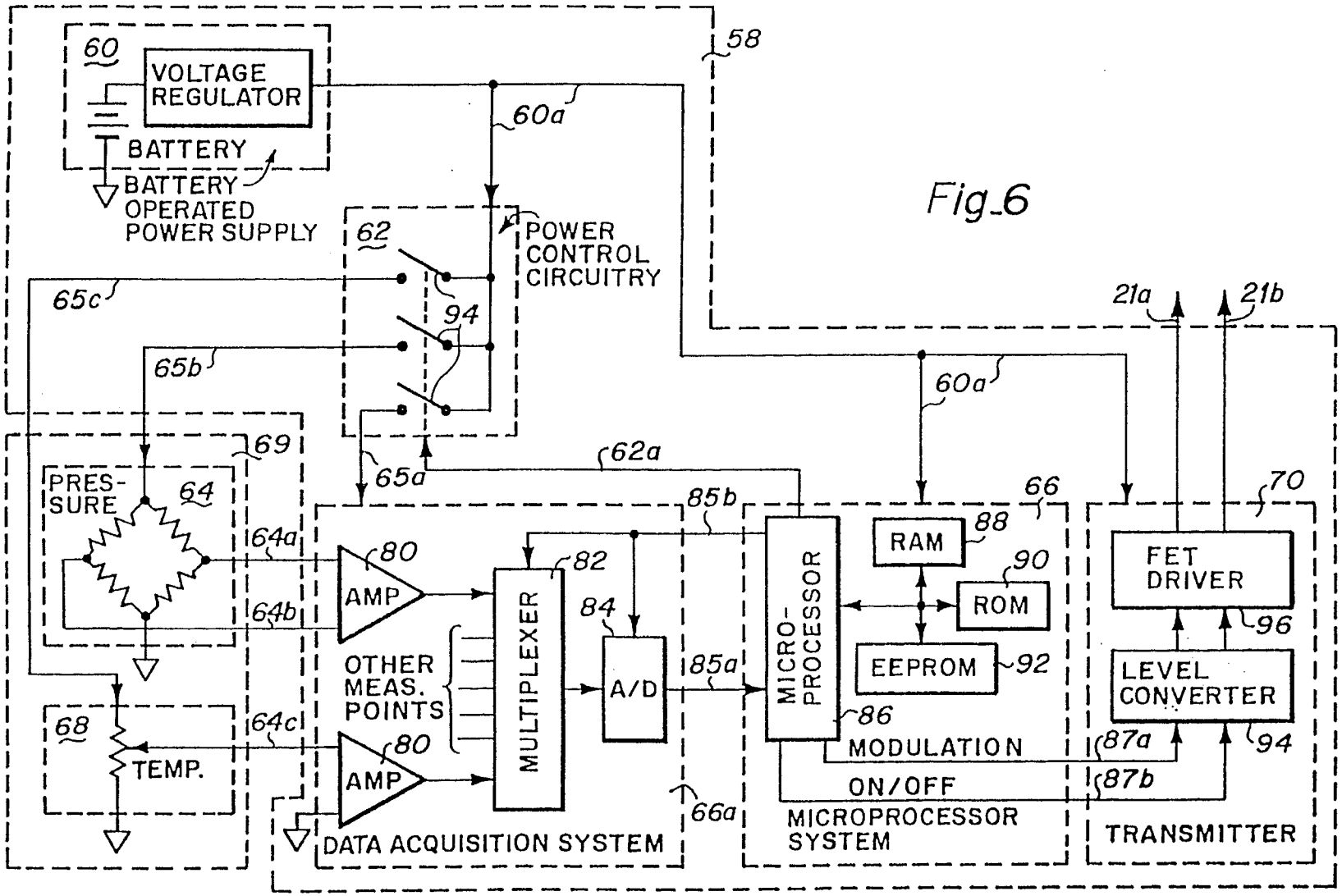
FIG. 6 illustrates in greater detail the communication system 58 circuitry.

FIG. 6 illustrates, in greater detail, the circuitry of the device 58. The battery operated power supply provides power, via a first power signal 60*a* to the power control circuitry 62, the microprocessor'system 66, and the transmitter 70.

The power control circuitry 62 includes a plurality of elements 94 (shown schematically as switches) which allows the microprocessor system 66 to selectively control which component or components (i.e. sensors and/or data acquisition system 66*a*) receive the power from the power supply 60.

The pressure sensor 64 and the temperature sensor 68 are typically resistance or capacitance type sensors which may be configured in bridge configurations, and are powered by the power control circuitry 62 via the second power voltage 65*b* and 65*c*. The sensors, which are either housed in the down-hole tool 18 or located proximate to the tool 18, may include a variety of sensor devices and are not limited to the pressure and temperature sensors illustrated in the figure. The pressure and temperature data signals 64*a*, 64*b*, 64*c* are output from these sensors to the data acquisition system 66*a*.

The data acquisition system 66a receives from the signals 64*a*, 64*b*, 64*c* which are representative of temperature or pressure levels present in the vicinity of the tool 18; the system 66*a* responds to a control signal 85*b* from, and outputs to the microprocessor system 66 the corresponding signal 85*a*. The system 66*a* includes a plurality of signal conditioning amplifiers 80, an analog multiplexer 82, and an analog-to-digital (A/D) converter 84. The microprocessor system 66 commands, via the signal 85*b*, the multiplexer 82 to select the appropriate sensor to monitor, and controls the A/D conversion process.

The microprocessor subsystem 66 receives the signal 85*a*, corresponding to the sensor outputs, from the system 66*a*. The system 66 outputs control/command signals 62*a*, 85*b* back to the data acquisition system 66*a* and the power control circuitry 62, and also outputs the signals 87*a*, 87*b* to the transmitter 70. The system 66 includes a microprocessor 86, a random access memory (RAM) 88, a read only memory (ROM) 90, and an electrically erasable programmable read only memory (EEPROM) 92. The microprocessor 86 controls the analog multiplexer 82 and the A/D converter 84 within the system 66*a*. The processor, through the control circuitry 62, controls the power feeds to the sensors 64 and 68, and the acquisition system 66*a*. Signal 85*a* corresponding to the down-hole sensor measurements (i.e. signals 64*a*, 64*b*, 64*c*) are received by the processor 86 and stored in the RAM 88. The processor 86 utilizes parameters stored in the EPROM 92 and the ROM 90 to provide the transmitter 70 with the signals 87*a*, 87*b* (which includes both a modulation signal 87*a* and an on/off signal 87*b*). The signal 87*a* includes preamble, data, error control coding, and postamble data.

The transmitter 70 input includes the modulation 87*a* and on/off signals 87*b* from the processor 86. The transmitter 70 includes level conversion elements 95 and field effect transistors 96 (FETs) for driving the upper and lower tool housings and ultimately the casing conducting portion 14*a*. The transmitter responds to the signals 87*a*, 87*b* and couples the first voltage 60*a* to the upper and lower tool housings 18*a* and 18*b* respectively via the conductors 21*a*, 21*b*. A current is caused to flow through the casing conducting portion and a corresponding electromagnetic field is generated.

Figure 7:
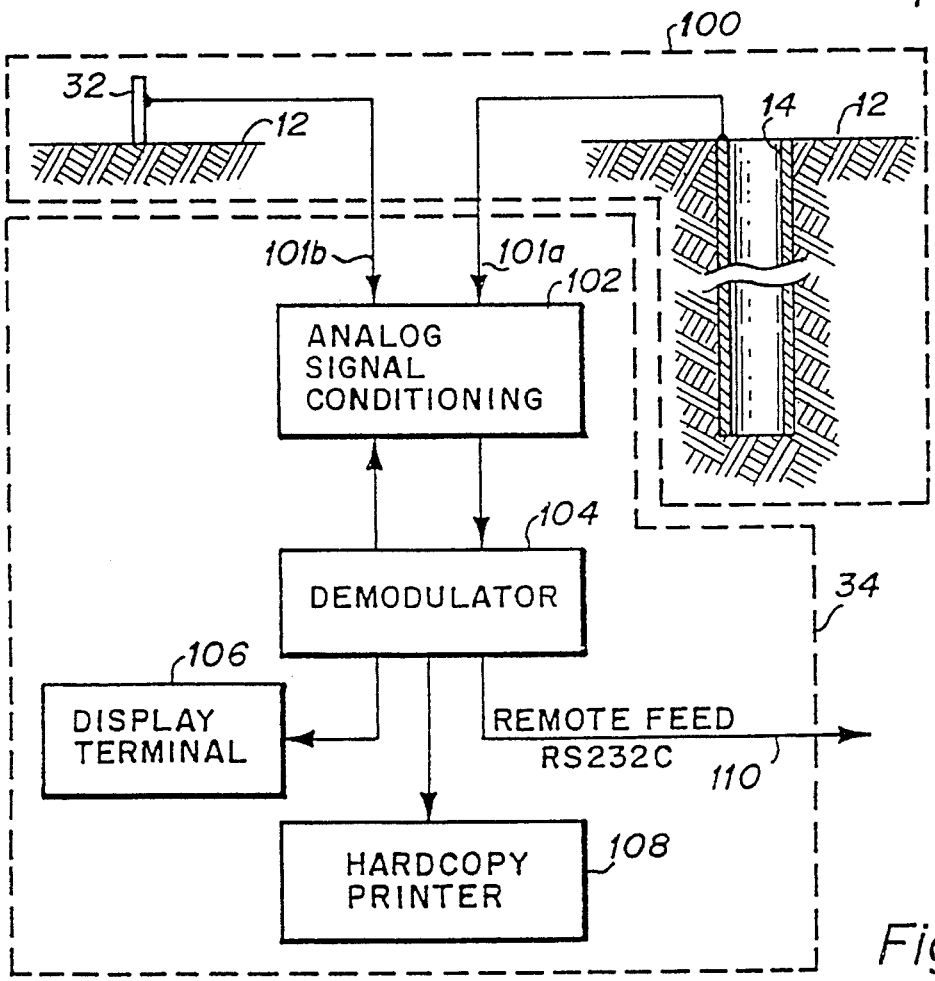
FIG. 7 depicts a block diagram of a surface receiver 34 for receiving the output from the communication system 58.

The signal produced by the device 58, disposed within the down-hole tool 18, is transmitted to the surface 11 by means of the electromagnetic field 30*a*. The field 30*a* is collected and processed by the surface receiver or antenna 34, a block diagram of which is illustrated in FIG. 7.

The electric field 30*a* is sensed by an antenna system 100 defined by the casing 14 and a remote electrode 32. Alternate surface antenna systems can also be employed, including two or more remote electrodes located on radials from the well-head. Signals 101*a*, 101*b* received by the antenna system 100 are sent to an analog signal conditioning block 102 where pre-amplification, bandpass filtering, and post-amplification are performed under control of a demodulator 104. The output of the analog signal conditioning block 102 feeds the demodulator 104 whose major component is a computer. The demodulation at the surface 11, like the modulation in the down-hole tool 18, is done in software. This allows the modulation/demodulation schemes to be changed on a per application basis with little or no changes to the hardware. The demodulator has output devices consisting of a display terminal, 106, a hardcopy printer 108, and an RS232C feed 110 that is capable of providing the demodulated measurements to the user.

Although the present invention has been described above in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A tool disposed within an elongated, electrically conductive casing beneath the surface of the earth, the tool comprising:

at least one sensor for sensing an environmental condition proximate the tool and outputing sensor data indicative thereof;

signal generator responsive to the sensor data output from the at least one sensor, the signal generator generating a signal indicative of the sensor data at first and second terminals thereof;

an enclosed housing encasing the signal generator, the housing having a first distal end including a first conductive housing portion and a second distal end including a second conductive housing portion, the first and second conductive housing portions being electrically insulated from each other, the first and second terminals of the transmitter being electrically connected to the first and second conductive housing portions, respectively;

first contacting member for electrically connecting an outer surface of the first conductive housing portion to the electrically conductive casing at a first position proximate the first distal end of the housing; and a second contacting member for electrically connecting an outer surface of the second conductive housing portion to the electrically conductive casing at a second position proximate the second distal end of the housing, wherein a modulating current indicative of the data output from the at least one sensor is caused to flow through a casing conducting portion of the electrically conductive casing between the first and second positions, creating a voltage potential therebetween, inducing an electromagnetic field which propagates to a receiver proximate the surface.

2. The tool according to claim 1, wherein the first and second conductive housing portions are electrically insulated from each other by an electrically insulated spacer.

3. The tool according to claim 1, wherein the at least one sensor includes a temperature sensor.

4. The tool according to claim 1, wherein the at least one sensor includes a pressure sensor.

5. The tool according to claim 1, wherein the signal generator comprises:

means for generating a modulation pattern signal indicative of the data output from the at least one sensor; and a transmitter outputing the modulation pattern signal at the first and second terminals.

* * * * *